US006447433B1

(12) United States Patent
Reyes

(10) Patent No.: US 6,447,433 B1
(45) Date of Patent: Sep. 10, 2002

(54) WEIGHT-BAR SUPPORT STRUCTURE WITH RETRACTABLE ARMS

(76) Inventor: Gilbert Reyes, 4960 Spanish Heights Dr., Las Vegas, NV (US) 89113

( * ) Notice: Subject to any disclaimer, the term of this patent is extended or adjusted under 35 U.S.C. 154(b) by 0 days.

(21) Appl. No.: 09/447,925

(22) Filed: Nov. 23, 1999

Related U.S. Application Data

(63) Continuation of application No. 08/849,926, filed on Jun. 2, 1997, now abandoned, which is a continuation of application No. PCT/US95/15583, filed on Dec. 4, 1995.

(51) Int. Cl.[7] ..... A63B 21/078
(52) U.S. Cl. ..... 482/104
(58) Field of Search ..... 482/93, 94, 97, 482/104, 106–108

(56) References Cited

U.S. PATENT DOCUMENTS

| | | | |
|---|---|---|---|
| 3,552,748 | A | 1/1971 | Thomas |
| 4,302,009 | A | 11/1981 | Johnson |
| 4,602,785 | A | 7/1986 | Rockwell |
| 4,637,608 | A | 1/1987 | Owens et al. |
| 4,890,831 | A | 1/1990 | Craig |
| 4,928,961 | A | 5/1990 | Madden |
| 5,151,072 | A | 9/1992 | Cone et al. |
| 5,162,031 | A | 11/1992 | Watson |
| 5,281,193 | A | 1/1994 | Colbo, Jr. |
| 5,472,397 | A | 12/1995 | Ammoscato et al. |
| 5,509,876 | A | 4/1996 | Reyes |

FOREIGN PATENT DOCUMENTS

| | | | |
|---|---|---|---|
| DE | 3744449 | A1 | 12/1987 |
| DE | 29501631 | | 2/1995 |
| EP | 0147908 | A1 | 4/1984 |
| SU | 1443892 | A1 | 4/1987 |

*Primary Examiner*—John Mulcahy
(74) *Attorney, Agent, or Firm*—Knobbe, Martens, Olson & Bear, LLP

(57) ABSTRACT

A weight-bar support structure is disclosed. The structure includes a user supporting platform or seat and two spaced apart posts. The first end of a weight-bar supporting arm is connected to a lug extending from each post. A second end of each arm includes a weight-bar supporting cradle and an upwardly extending guide. The arms are moveable from a retracted position to a user lift-off position. A spring having a first end connected to the arm and a second end located in a slot in the lug biases each arm, when a weight laden bar is removed therefrom, from the lift-off to the retracted position.

20 Claims, 10 Drawing Sheets

WEIGHT-BAR SUPPORT STRUCTURE WITH RETRACTABLE ARMS

RELATED APPLICATIONS

This application is a continuation of prior application Ser. No. 08/849,926 filed on Jun. 2, 1997 now abandoned; which is a continuation of 35 U.S.C. §371 to application PCT/US95/15583 filed on Dec. 4, 1995; which claims priority from application Ser. No. 08/349,749 filed Dec. 2, 1994, now issued U.S. Pat. No. 5,509,076.

FIELD OF THE INVENTION

The present invention relates to a weight bench for supporting a weight-laden bar. In particular, the present invention relates to a weight bench having arms for supporting a weight-bar, the arms movable between a retracted position and a lift-off position.

BACKGROUND OF THE INVENTION

Current wisdom, both among the current population and physicians, trainers, and other health care related personnel, is that exercise is beneficial to the health and well-being of individuals. For this reason, more and more individuals are engaging in exercise programs to build muscular strength and improve cardiovascular capacity.

Recently, some fitness experts have declared one or more of the "standby" weight training exercises as undesirable or dangerous. In particular, some have declared these exercises unhealthy, or as creating a risk of injury high enough that they are not recommended to the majority of the population. Unfortunately, no substitute exercise is often available which is as effective as the particular weight-training exercise.

One exercise which has been viewed at times with some negativity is the bench press. In this exercise, a user lays on his back on a bench, and then raises and lowers a weight-laden bar over his chest while grasping the bar with his hands. This exercise can entail the lifting of a considerable amount of weight, often hundreds of pounds. The actual pressing of the weight-laden bar up and down does not pose the most substantial risk of injury during the exercise, however.

To commence a bench press, the bar must be retained in a position away from the bench so the person exercising can move into the correct position on the bench. Once positioned on the bench, the user moves the bar into position and starts the exercise.

Normally, the person exercising lays on a flat bench located between two upwardly extending support posts. The bar, in its resting position, is located on hooks extending outwardly from the posts. The user lays on the bench, reaches upwardly and grasps the bar, and then removes it from the hooks to begin the exercise.

In order that the support posts and hooks not obstruct the area in which the exerciser moves the bar up and down during the exercise, the support posts are located behind the user's shoulders and approximately on either side of the user's head. The location of the posts means that the user must reach backwardly to grasp the bar and lift it off of the posts.

Because the support posts are located behind the lifter's head, his arms are in an awkward position when the bar is lifted from the supports. In this position, the exerciser has reduced strength and control over the weight, and the shoulders are in a position in which they are most susceptible to extreme stress and injury. A lifter otherwise capable of completing the exercise of moving the bar up and down over his chest can injure himself when attempting to lift the bar from the posts.

One method of reducing this risk of injury has been to have a "spotter" aid in lifting the bar from the hooks and positioning the bar over the chest of the exerciser. In addition to the inconvenience of requiring the presence of a second person, this method has two serious drawbacks which can result in injury to both the spotter and the exerciser. First, the spotter must stand behind the head of the exerciser and lift the bar off of the posts. The spotter reaches forward and lifts the bar from the posts in a maneuver which approximates an upright rowing exercise. The spotter then moves the bar outwardly from his body over the chest of the exerciser. When the spotter lifts the bar from the posts, the spotter is lifting a substantial amount of weight in a weak position. The spotter often suffers shoulder injuries as a result. Secondly, because the exerciser and bench prevent the spotter from moving forward, the spotter must lean over or extend his reach to place the bar over the exerciser's chest. The spotter can suffer back, shoulder, and arm injuries as a result.

Moreover, the exerciser can suffer injuries when a spotter is used. Because the exerciser does not lift all of the weight on the bar from the post, the exerciser does not adjust and stabilize the bar as it is removed from the post. Therefore, when the spotter releases his grip from the bar when it is located over the exerciser, the shift in weight to the exerciser is often so sudden that the exerciser has difficulty in stabilizing the bar. As a result, the exerciser can drop the bar, or injure shoulder or arm muscles attempting to right the bar.

Another risk of injury from the bench press exercise arises if the exerciser is incapable of returning the weight-laden bar to the hooks on the support post. This often occurs when the exerciser is fatigued and unable to press the bar high enough to reach the hooks.

Normally, exercisers also engage a spotter who aids in raising the bar to its resting position if the exerciser encounters these difficulties. As described above, however, because of the position of the spotter and the exerciser, the spotter is not in position in which he can offer substantial leverage to lift the bar from the exerciser, and can injure himself attempting to reach over and lift the bar upwardly.

Other exercises which have substantially the same arrangement whereby the bar is supported in a resting location which is not easily reached by the exerciser for use present many of the same problems and risks of injury. Such exercises include the incline bench press, the decline bench press, and the military bar press.

SUMMARY OF THE INVENTION

In accordance with the present invention a weight-bar support structure having weight-bar supporting arms which are movable between a first retracted weight-bar supporting position and a second weight-bar lift-off position is provided.

In a first form of the invention, the support structure includes an elongate horizontally mounted user supporting platform, and two upwardly extending posts located on either side of the platform. A weight-bar supporting arm is connected to a lug extending outwardly from each post.

The arm has a first end portion connected to the lug. Pins pass through a sleeve in outer flange portions on each side of the arm and engage opposite sides of the lug. In this fashion, the arm is rotatably connected to the lug.

A "J"-shaped weight-bar support member is located at a second end portion of the arm. The bottom portion of the "J"-shaped member forms a bar supporting cradle. The top portion of the "J"-shaped member acts as a guide means for directing the bar back into the cradle.

Each arm is moveable from a first retracted position in which the arm extends substantially upwardly along the post, to a weight-bar lift-off position in which the arm extends outwardly over the platform. A cushion is located on the lug for engagement with a bottom edge of the arm for limiting the rotation of the arm at the lift-off position. A stop located on the back of the arm engages another cushion on the lug for limiting the rotation of the arm at the retracted position.

Return or biasing means are provided for automatically moving the arms from the lift-off position to the retracted position when the user removes the weight-bar from the arms. The return means comprises a flat spring having a first end connected to the arm and a second end connected to the lug.

In use of this form of the invention, primarily for use in the exercise known as the "bench press," a user places a bar into the cradles of each arm with the arms in the retracted position. The user lays on the platform and moves the bar and arms to the lift-off position. When the user lifts the bar from the cradles, the spring in each arm returns the arm to the retracted position. After the user has completed the exercise, he moves the bar against the guides, and downwardly into the cradles.

A second form of the invention comprises a device for use by a user in doing a "military" press exercise. In this form of the invention, the device includes a user-engaging platform in the form of a seat, and a weight-bar support structure.

The seat and a seat back are supported by a seat frame. The weight-bar support structure includes two posts extending vertically upwardly on either side of the seat and in front thereof. The posts are supported by a frame which is connected to the frame which supports the seat.

Lugs extend outwardly from the top end of each of the posts in the direction of the seat. Movably mounted on each lug is a weight-bar supporting arm like that described above.

In using this form of the invention, the user places a weight-bar into the cradles of each arm with the arms in retracted position. The user sits on the seat with his back against the seat back, and moves the arms to the lift-off position. When the user lifts the bar upwardly, the arms return to their retracted position. After completion of the exercise, the user places the bar back into the cradle of each arm.

A third form of the invention comprises a device for use by a user in doing an "incline" press exercise. In this form of the invention, the device includes a user-engaging platform in the form of a seat, and a weight-bar support structure.

The seat and a seat back are supported by a frame. The weight-bar support structure includes two posts extending vertically upwardly on either side of the seat. The seat is located forwardly of the arms, while the seat back slopes upwardly and rearwardly from the seat to a point behind the arms. The posts are supported by a frame which is connected to the frame which supports the seat.

Lugs extend outwardly from the top end of each of the posts in the direction of the seat. Movably mounted on each lug is a weight-bar supporting arm like that described above.

In using this form of the invention, the user places a weight-bar into the cradles of each arm with the arms in retracted position. The user sits on the seat with his back against the seat back, and moves the arms to the lift-off position. When the user lifts the bar upwardly, the arms return to their retracted position. After completion of the exercise, the user places the bar back into the cradle of each arm.

A fourth form of the invention comprises a device for use by a user in doing either an "incline" press or "military" press exercise. In this form of the invention, the device includes a user-engaging platform in the form of first and second seats and a seat back, and a weight-bar support structure.

The weight-bar support structure includes two posts extending vertically upwardly and spaced apart by a horizontal support. The seat members and seat back are located between the posts. The first seat member is located adjacent the support, and the second seat member is located outwardly of the support in front of the arms. The seat back extends upwardly between the first and second seat members. The seat back is movable from a first position in which it extends vertically upward, to a second position in which it slopes upwardly and rearwardly to a position behind the arms. Lugs extend outwardly from the top end of each of the posts. Movably mounted on each lug is a weight-bar supporting arm like that described above.

In using this form of the invention, the user places a weight-bar into the cradles of each arm with the arms in retracted position. To do a "military" press, the user places the seat back in a vertical position and sits on the first seat member facing the arms. To do an "incline" press exercise, the user tilts the seat back rearwardly and sits on the second seat member, facing away from the arms. The remainder of the exercise is like that described above.

Further objects, features, and advantages of the present invention will become apparent from the detailed description of the drawings which follows, when considered with the attached figures.

DETAILED DESCRIPTION OF THE PREFERRED EMBODIMENT

Figure 1:
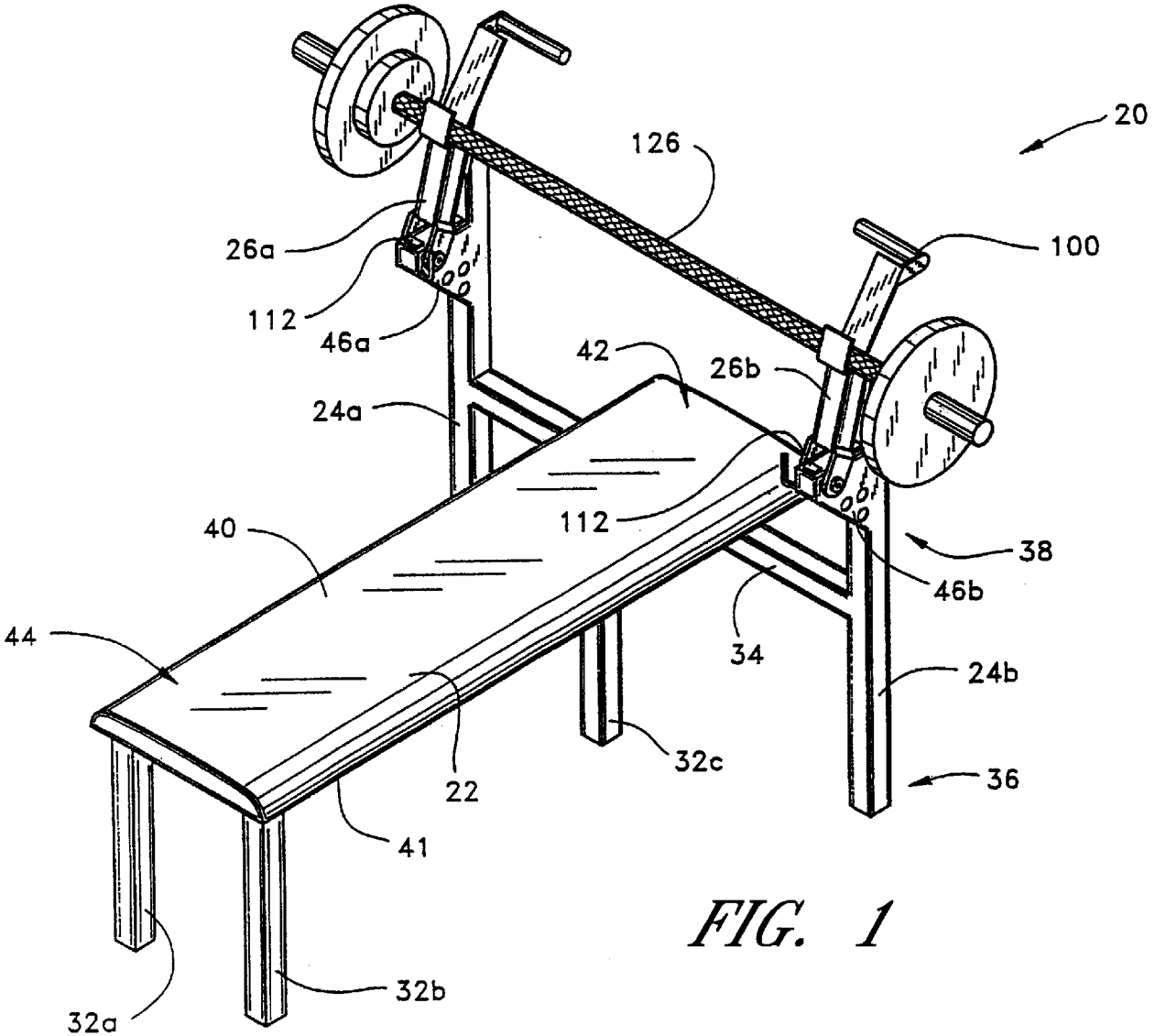
FIG. 1 is a perspective view of a first embodiment of the weight-bar supporting structure of the present invention, illustrated with arms thereof in a retracted position.

FIG. 1 illustrates a weight-bar support structure 20 in accordance with a first form of the present invention. In general, the structure 20 preferably includes a user supporting platform 22, two upwardly extending posts 24*a,b,* and a weight-bar supporting arm 26*a,b* located on each post. The platform 22 is supported by at least one, and preferably three legs 32*a,b,c,* and a cross-beam 34 extending between the posts 24*a,b.*

Vertical posts 24*a,b* are spaced about 40–50, and most preferably about 45 inches apart. Each post 24*a,b* is about 30–40, and most preferably about 35 inches tall, having a first end portion 36 for contacting the ground, and a second free end portion 38. The posts 24*a,b* are constructed of a rigid strong material such as aluminum or steel. A-36 steel in hollow tubular form about 2 inches square with a wall thickness of about 3/16 of an inch is useful. A flat plate or similar member may be located on the bottom of each post to protect the surface on which the posts rest, and to provided added support to the structure.

The cross-beam 34 is preferably about 45 inches long, and extends between the two posts 24*a,b.* The exact length of the cross-beam 34 is determined by the distance the posts 24*a,b* are set apart, as it connects them.

The cross-beam 34 extends perpendicularly to the vertical posts 24*a,b* about 12–14 inches above the ground. The cross-beam 34 extends between the posts 24*a,b* a distance above the ground approximately equal to the distance above the ground an exerciser is supported when the user is exercising. The exerciser is supported between 12 and 18 inches, and most preferably about 16 inches above the ground during exercise. This distance allows for most users to sit or lay on the platform 22 and have their feet touch the ground. Each leg 32*a,b,c,* described in more detail below, is about 13 inches long, preferably equal in length to the height the cross-beam 34 is located above the ground. Each leg 32*a,b,c* may include a flat foot or similar member for reducing the marring of the surface on which they rest.

As can be seen in FIG. 1, the platform 22 is generally elongate and is supported in a generally horizontal position by the legs 32*a,b,c* and the cross-beam 34. The user supporting platform 22 is about 45–50 inches long, 11–12 inches wide, and 3–5 inches thick. The platform 22 is preferably made of wood or metal with a layer of padding located on an upper surface 40 thereof. In particular, a layer of foam or similar padding is located over the base material, with a layer of vinyl, leather or similar durable material located over the padding. The platform 22 also includes a bottom surface 41, and a first end portion 42 and second end portion 44. A central structural support (such as a 2 inch square metal tube, not shown) runs along the length of the bottom surface 41 of the platform 22 and may be connected to the cross-beam 34 and an end support to which the legs 32*a,b* are connected, to provide added support and rigidity.

The first end portion 42 of the platform 22 is preferably located on and supported by the cross-beam 34. The bottom surface 41 of the platform 22 is secured, at the first end portion 42, to the cross-beam 34 so as to prevent movement with respect thereto, by welding, bolts, screws or similar attachment means.

The second end portion 44 of the platform 22 is supported by two legs 32*a,b.* The legs 32*a,b* are securely connected to the end support (such as a 2 inch square metal tube, not shown) extending across the bottom surface 41 of the platform 22. The legs 32*a,b* are preferably attached directly to the end support and/or platform 22 by welding, bolts, screws or similar attachment means.

The third leg 32*c* is attached to the central support extending along the bottom surface 41 of the platform 22 as well. The third leg 32*c* is located between the first and second end portions 42,44 of the platform 22, preferably about 9 inches from the cross-beam 34 towards the second end portion 44 of the platform 22. The third leg 32*c* is to further support of the center of the platform 22 near where the majority of the weight is supported during exercise.

Each leg 32*a,b,c* is made of a strong, durable material such as steel, aluminum or the like. In one embodiment, the legs 32*a,b,c* are made of A-36 steel, and are square and hollow. The outer dimension of each leg 32*a,b,c* is about 1.5–2.5 inches, having a wall thickness of about 3/16 of an inch. The legs 32*a,b,c* can also be constructed of a solid material. However, when the legs 32*a,b,c* are constructed of a solid material, their outer dimension may be enlarged to create the visual appearance of a stronger support structure.

The cross-beam 34 is preferably made of the same material as the legs 32*a,b,c.* When the cross-beam 34 and posts 24*a,b* are made of metal, the cross-beam 34 is welded to the posts 24*a,b.*

The legs 34*a,b,c* and cross-beam 34 described herein comprise the preferred means for supporting the platform 22 in an elevated position above the ground. However, other support means may be used, as well known to those skilled in the art.

Figure 4:
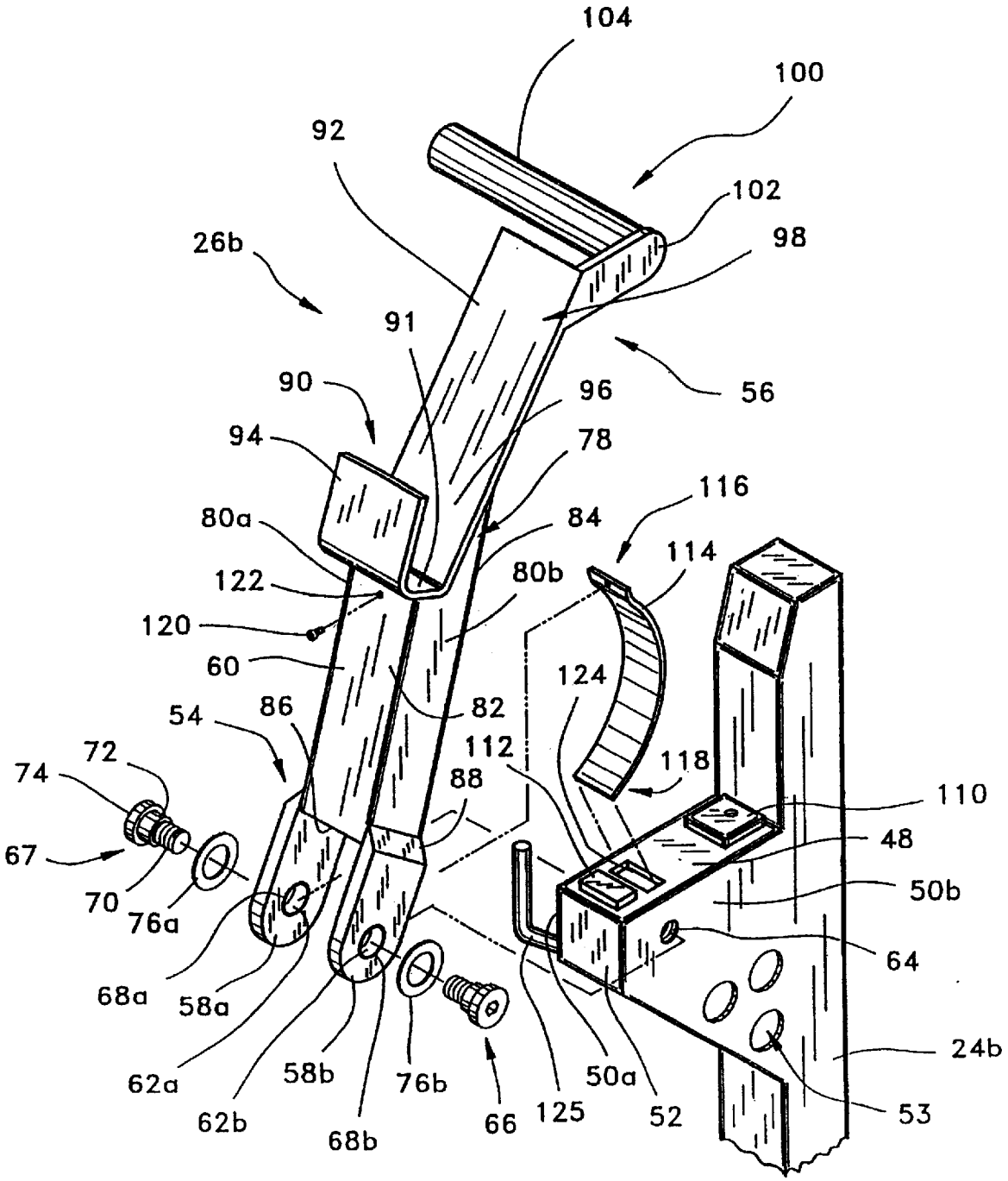
FIG. 4 is an exploded view of the portion of the weight-bar supporting structure illustrated in FIG. 3.

As illustrated in FIG. 1, an outwardly extending shoulder or lug 46*a,b* is located near the second end portion 38 of each post 24*a,b.* A weight-supporting arm 26*a,b* is connected to each of the lugs 46*a,b.* Each lug 46*a,b* is located about 8–12 inches down from the top of the post 24*a,b,* and extends towards the second end portion 44 of the platform 22. As best illustrated in FIG. 4, each lug includes a top surface 48, side surfaces 50*a,b,* and a front end 52.

Each lug 46*a,b* extends outwardly from its corresponding post 24*a,b* about 3–9 inches, and most preferably about 5 inches, towards the second end portion of the platform 22. The top surface 48 of each lug 46*a,b* is preferably parallel to the ground and platform 22.

The top surface 48 is preferably as wide as the post 24*a,b.* The front end 52 is preferably a flat surface approximately 2 inches square. Each side surface 50*a,b* extends downwardly from the top surface 48 along the post 24*a,b* about 3–5 inches, and extends downwardly along the front end 52 about 2 inches so that it is flush therewith. As illustrated, a number of holes 53 may be located in the sides 50*a,b* for ornamentation, and for reducing the overall weight of the structure.

Each lug 46*a,b* can be manufactured in any number of ways. In one method, a flat section of material is bent form the side 50*a,b* and top surfaces 48. This piece of material is connected to the post 24*a,b.* An end piece is then connected to the first section of material to form the front end.

Preferably, each lug 46*a,b* is made entirely of metal, such as A-36 steel having a thickness of 3/16 of an inch. When formed as described above, the lugs 46*a,b* are constructed by welding the piece or pieces of material to each post 24*a,b.*

In a second method of constructing the lugs 46*a,b,* a 2 inch square pieces of tubular metal is welded to the post 24*a,b.* A section of 2 inch square sheet metal is welded over the open end of the tubular piece of metal to form the front end 52, and sheets of metal are welded onto the tubular piece and posts to form the side surfaces 50*a,b*.

Figure 3:
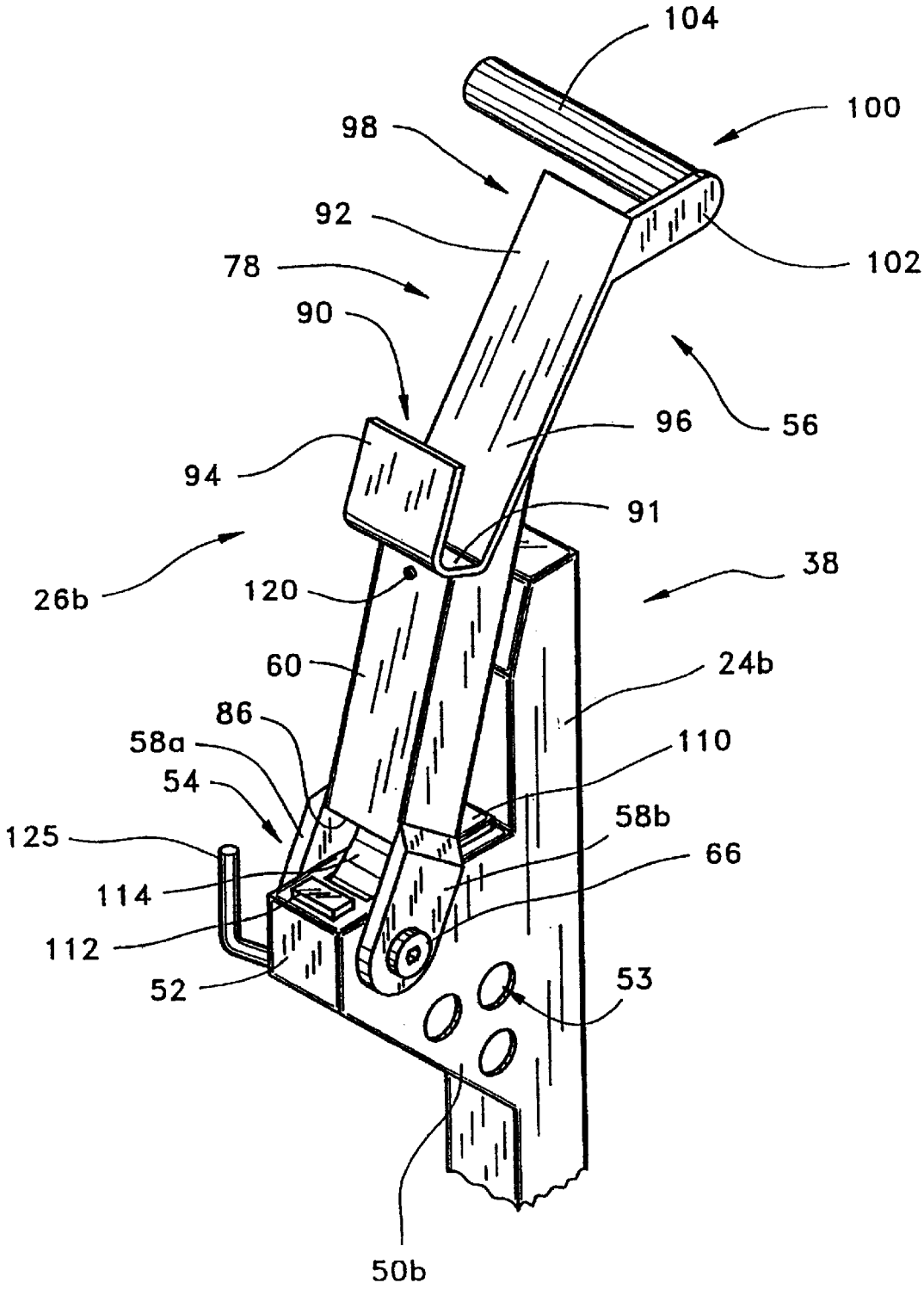
FIG. 3 is a enlarged perspective front view of a portion of the weight-bar supporting structure of FIG. 1 illustrating a portion of a post and an arm connected thereto.
Figure 5:
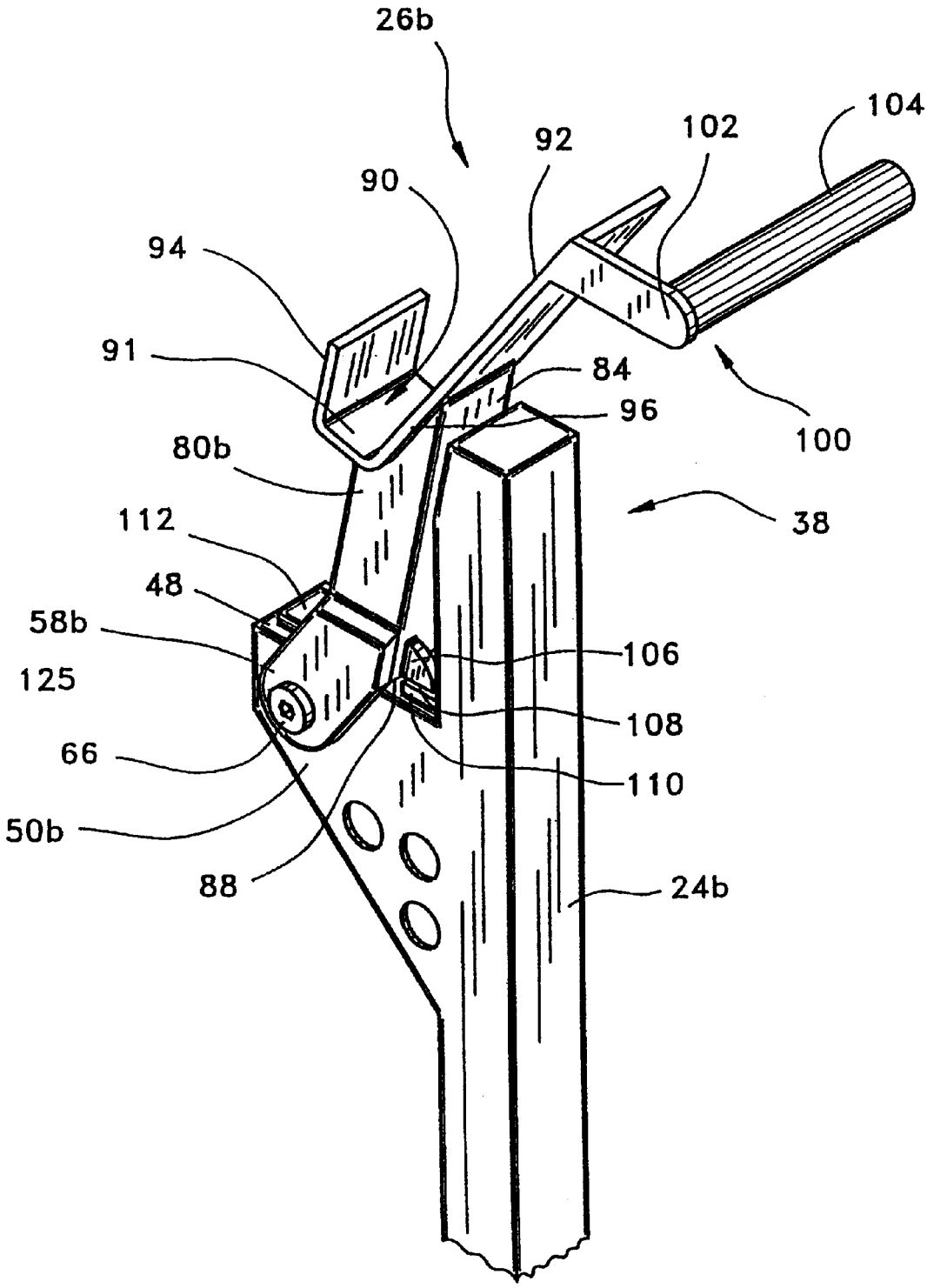
FIG. 5 is an enlarged perspective rear view of the same portion of the weight-bar structure illustrated in FIG. 3.

Weight-bar support means, preferably in the form of arms 26*a,b,* are connected to the support structure 20. Preferably, an arm 26*a,b* is connected to each of the lugs 46*a,b* and includes rotational means for allowing the arm 26*a,b* to move with respect to the lug. Because each of the arms 26*a,b,* and their connection to the lugs 46*a,b,* are preferably identical, the following description, while only for one of the arms 26*b* as best illustrated in FIGS. 3–5, applies to each of them in the same manner.

The arm 26*b* has a first end portion 54 and second end portion 56. The first end portion 54 is connected to the lug 46*b*. The first end portion 54 preferably includes spaced downwardly extending flanges 58*a,b* which straddle the lug 46*b,* one flange 58*a* located over one side surface 50*a* of the lug and the other flange 58*b* located over the other side surface 50*b* of the lug.

Each flange 58*a,b* extends downwardly from a central portion 60 of the arm 26*b,* and includes aligned bores 62*a,b* located therein. The bores 62*a,b* in the flanges 58*a,b* are aligned with a bore 64*b* passing through the lug 46*b*.

Preferably, each flange 58*a,b* is connected to the lug 46*b* with bolts 66,67. The bore 64 in the lug 46*b* is threaded where it passes through the side wall surfaces on each side 50*a,b*. A sleeve 68*a,b* is press-fit into the bore 62*a,b* in each flange 58*a,b*. Bolts 66,67 have a first threaded end portion 70, an intermediate non-threaded portion 72, and a head 74 at a second end and connect the arm 26*b* to the lug 46*b*.

Each bolt 66,67 passes through the flange 58*a,b,* the first end portion 70 engaging the threads in the bore 64 in the lug 46*b*. When in this position, the sleeve 68*a,b* in each flange 58*a,b* engages the intermediate non-threaded portion 72 of the bolt, with the head 74 located outside of the flange. Preferably, a washer 76*a,b* is located between the head 74 and the outer surface of each flange 58*a,b,* as illustrated in FIG. 4.

In the preferred construction of the lugs 46*a,b* described above, the wall thickness of the side portions is approximately about ⅜ of an inch. In order to increase the effective threaded engagement area of each lug 46*a,b* with the bolt 66, a nut (not shown) is connected to the inside surface of each side 50*a,b* of the lug, the nut having a thickness of about 0.25 to 0.75 inches. When a nut is used, it is welded or attached to the side walls of the lug such that they do not protrude from the outwardly facing surface thereof.

As illustrated in FIG. 3, the central portion 60 of the arm 26*b* extends between the flanges 58*a,b* at the first end portion 54 thereof, and a weight-bar support member 78 located at the second end portion 56. The central portion 60 is preferably constructed from 2 inch by 2 inch metal tubing having a square cross-section. Tubing of A-36 steel having a wall thickness of about 3/16 of an inch has been found acceptable.

When in this form, the central portion 60 of the arm 26*b* has two outwardly facing side surfaces 80*a,b,* a front surface 82, and rear surface 84. The flanges 58*a,b* are preferably formed as extensions of the side surfaces 80*a,b*. The flanges 58*a,b* and central portion 60 can be formed from a single piece of material, but also by the addition of the flanges by welding or the like, to the material which constitutes the central portion.

Because the flanges 58*a,b* extend downwardly from each side 80*a,b* of the central portion 60, edges 86,88 are formed at the bottom of the support on the front 82 and rear 84 sides, respectively.

When having the form described above, the lengthwise dimension of the central portion 60 of each arm 26*a,b* is about 5–12 inches, and most preferably about 8.5 inches. Each flange 58*a,b,* when having a "U"-shape as illustrated, has a radius of about 1–2 inches, and most preferably about 1.5 inches. The bores 62*a,b* in each flange 58*a,b* have a diameter of about 0.5 inches, for accommodating bolts 66,67 having approximately the same diameter non-threaded portion 72.

The weight-bar support member 78 is preferably "J"-shaped, having a bar cradle portion 90 and an upwardly extending bar guide means 92. Preferably, the member 78 is formed from a single piece of material connected to and supported by the central portion 60.

The cradle 90 is the bottom of the "J"-shaped section of the member 78 which is attached to the central portion 60. A first stem 94 of the "J" is located slightly outwardly of the front side 82 of the central portion 60 and extends upwardly about 1–2 inches, and most preferably about 2 inches. The cradle 90 itself has a substantially flat bottom surface 91, separating the first stem 94 from a second stem 96 by about 1.5 inches. The second stem 96 extends upwardly from the flat bottom 91 into the top guide means 92 portion of the "J". The cradle 90 is preferably constructed of metal, and has a width from 1–5 inches, and preferably about 3 inches.

The width of the flat bottom 91 of the cradle 90 is greater than the diameter of a bar, allowing a bar placed therein to rest directly on the bottom. The upwardly extending first stem 94 prevents the bar from bouncing, rolling or falling from the cradle 90.

The guide means 92 slopes upwardly and backwardly the second stem 96. From the bottom of the cradle 90 to a top end 98 of the weight-bar support 78, the distance is preferably about 5–10 inches, and most preferably about 7–8 inches. The width of the guide means or 92 is about the same as the width of the cradle 90.

As stated above, the guide 92 slopes rearwardly from bottom to top, as compared to the front and rear sides 82,84 of the central portion 60. Preferably, the bottom of the cradle 90 is located approximately over the front side 82 of the central portion 60, and the top of the guide 92 is located rearwardly of the rear side 84 of the main support portion by several inches. Thus, the guide 92 is offset at an angle of about 10–40 degrees, preferably about 30 degrees, to the arm 26*b*.

A handle 100 extends from the top end 98 of the support 78. The handle 100 includes a mounting flange 102 extending rearwardly from the guide 92, and a cylindrical grip 104. The flange 102 is a thin piece of material welded to an outside edge of the guide 92. The grip 104 is preferably a tubular member which extends inwardly from the flange 102. The grip 104 has a diameter of about 1 inch, and has a length of about 5–15 inches, and most preferably about 8–10 inches. Foam, rubber, or other material may be located over the grip 104 when it is made of metal to make the grip user friendly.

A stop 106 is located on the rear side 84 of the central portion 60 for limiting the rearward travel of the arm 26*b* with respect to the lug 46*b*. The stop 106 extends outwardly from the central portion 60 about 1 inch, and includes a flat lower surface 108. This surface 108 is approximately even with the bottom edge 88 of the central portion 60 at the rear side 84 thereof.

The stop 106 engages a cushion 110 located on the top surface 48 of the lug 46*b*. As illustrated, the cushion 110 is a small block of durable, but slightly flexible, energy absorbing material securely connected to the lug 46*b* near the post 24*b*. Neoprene has been found to be an especially good cushion material. The cushion 110 is about 1 inch long and 2 inches wide, and is attached to the lug 46*a,b* via offset screw, adhesive or other attachment means well known in the art.

A similar cushion 112 is located near the front end 52 of the lug 46*b* on the top surface 48. This cushion 112 preferably comprises a similar material, and is about 2–2.5 inches in width and about 0.5 inches in depth. The cushion 112 is located on the lug 46*b* in a position for engaging the front edge 82 of the central portion 60 of the arm 26*b*.

As can be seen in FIGS. 1 and 3, the second end portion 38 of each post 24*b* preferably extends slightly upwardly beyond the lug 46*b* which supports the arm 26*b*. The posts 24*b* extend about 1–5 inches beyond the top surface 48 of the lug 46*b*.

Most importantly, to accommodate the backward tilting guide means 92 located on the arm 26*b*, and to prevent it from hitting the post 24*b* or having a user's fingers become trapped therebetween, the front side of the post in this area slopes backwardly. The exact slope depends on the slope of the guide 92 and the height of the post 24*b*, but in any case should leave 0.5–3 inches of space between the post 24*b* and the arm 26*b* when each arm is closest to the post.

Figure 2:
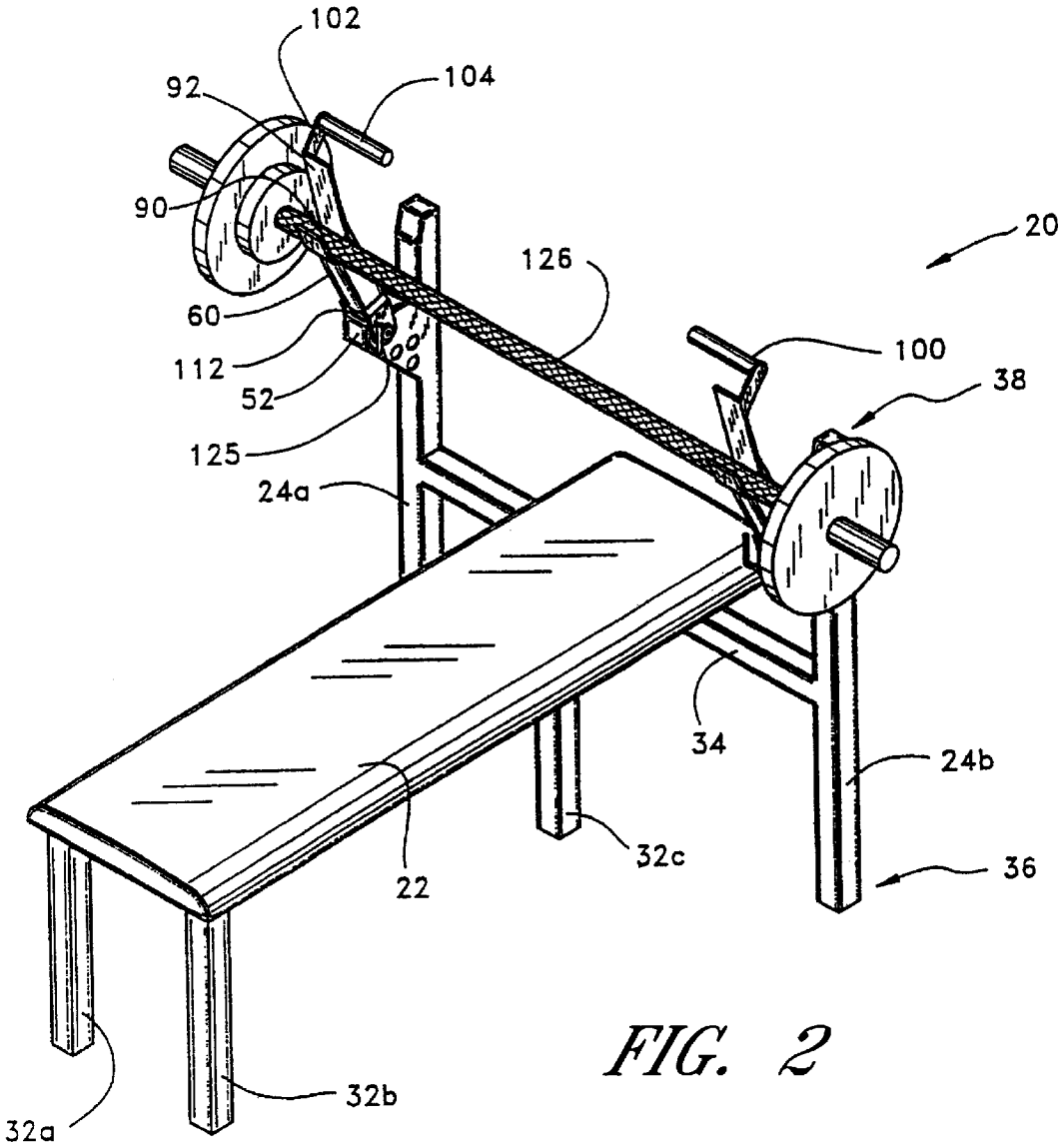
FIG. 2 is a perspective view of the weight-bar supporting structure of FIG. 1 illustrated with the arms thereof in a lift-off position.

The above-described arm/lug combination allows each arm 26*a,b* to move from a first retracted position, to a second lift-off position, as illustrated in FIGS. 1 and 2. The arms 26*a,b* are in their retracted position when the stop 106 located on the rear surface 84 of the central portion 60 of the arm is in contact with the cushion 110 on the lug, as illustrated in FIGS. 1 and 5. In the lift-off position, the arms 26*a,b* extend away from the posts 24*a,b*, with the leading edge 86 of the central portion 60 of each arm 26*a,b* engaging the cushion 112 near the front end of the lug 46*a,b*, as illustrated in FIG. 2. Rotational attachment of the arms 26*a,b* to the lugs 46*a,b* via the bolts 66,67 allows for movement of the arms between these two positions.

Preferably, return or biasing means are provided for automatically moving the arms 26*a,b* from the lift-off position back to their retracted position. In the preferred embodiment, the return means comprises a spring 114, as illustrated in FIG. 4.

The spring 114 is an elongate body, preferably constructed of metal, which is curved to create a biasing force from a first end portion 116 to a second end portion 118. The spring 114 is approximately 6–8 inches, and most preferably about 7.5 inches long, and 1–2 inches wide. The maximum depth in curvature with respect to the ends 116,118 depends on the desired spring force, but is preferably around 1 inch.

The first end portion 116 is connected to the inside of the arm 26*a,b* within the hollow interior of the central portion 60. An Allen screw 120 passes through the front side 82 of the main support portion just below the cradle 90 and engages a threaded hole 122 in the first end portion 116 in the spring 114.

The second end portion 118 of the spring 114 passes through a slot 124 located in the top surface 48 of the lug 46*a,b*. The slot 124 is located rear of the front end 52 of the lug 46*a,b* by about 1.5 inches, and is about 0.5 inches in length (front to rear) and 2–2.5 inches wide (side to side). Because the first end portion 116 of the spring 114 is securely connected to the arm 26*a,b*, no direct attachment means are used to locate the second end portion 118 of the spring 114 in the slot 124.

An upwardly extending catch, in the form of a pin 125, is located on each lug 46*a,b*, for use in stationing a bar on the lugs 46*a,b* in case of emergency, as described below. The pin 125 is somewhat "L"-shaped, having a first end connected to the inside surface 50*a* of the lug 46*b*, and a second free end located vertically above the top surface 48 of the lug. It is also contemplated that the pin 125 may be located on the outside surface 50*b* of the lug 46*b*, or extend from the end 52 thereof. Further, it is possible for the catch to take other forms, such as an "L"-shaped extension of the lug 46*b* extending outwardly and slightly upwardly.

Use of the weight-bar support structure 20 described above is as follows.

An exerciser locates a weight-bar 126, with or without additional weights thereon, on the structure 20. The user places the bar 126 in horizontal fashion within the cradles 90 located on each arm 26*a,b* with each arm in retracted position as illustrated in FIG. 1. In this position, the bar 126 is supported towards the outer ends thereof by the spaced cradles 90.

Next, the user lays on his back on the platform 22, with his head under the bar 126 between the two posts 24*a,b*. The user or a spotter then moves the arms 26*a,b*, and thus the bar 126, into the lift-off position. The user moves the bar into lift-off position by pulling slightly on any portion of the bar 126 or either arm 26*a,b*, pulling the arms 26*a,b* and bar 126 forward. A spotter can move the bar into lift-off position for a user by grasping the handles 100 and pushing them forwards.

In either instance, the weight of the bar 126 and arms 26*a,b*, along with any pulling or pushing force, rotate them to the lift-off position against the force provided by spring 114. Rotation of the arm 26*a,b* stops when the front edge 86 of the central portion 60 of each arm contacts the cushion 112 near the front end 52 of the lug. At all times, however, the load on each arm 26*a,b* is born by the lugs 46*a,b* through the bolts 66,67. The cradle 90 prevents the bar 126 from sliding, bouncing or rolling from the cradle 90 when the arms 26*a,b* are moved to the lift-off position, without regard to how quickly the arms are moved to this position.

The weight of the bar 126 maintains the arms 26*a,b* and the bar 126 in the lift-off position, overcoming the force of the spring 114. At this time, the bar 126 is conveniently located directly over the chest of the exerciser. The exerciser reaches up, grasps the bar 126, and presses it upwardly out of the cradles 90.

As the user removes the bar 126 from the cradles 90 on the arms 26*a,b*, the reduced weight biasing force is overcome by the spring 114, causing each arm 26*a,b* to begin moving back towards the retracted position. Once the user has completely lifted the bar 126 from the arms 26*a,b*, the arms are immediately returned by the spring 114 back to the retracted position. Movement of the arms 26*a,b* to the retracted position is stopped when the stop 106 on the arm 26*a,b* encounters cushion 110 on the lug 46*a,b*.

After the user has completed the exercise, he returns the bar 126 back to the cradles on the arms of the support structure 20. The user maintains the bar 126 pressed upwardly above him, and then moves the bar backwardly until it hits the guide 92 on each arm 26*a,b*. The guide 92 prevents further rearward movement of the bar 126, and aids the user in guiding the bar 126 into the cradles 90.

Most importantly, the ability of the exerciser to move the bar from a supported stationary position to a position in which it is ready for use reduces the injuries caused when the exerciser begins the exercise.

Preferably, a spotter is present during all phases of exercise. The present mechanism reduces risks of injury to the spotter when the bar is moved from the retracted to the lift-off position. In particular, as stated above, the spotter no longer needs to actually lift any weight and transfer it to the user. Instead, the user or the spotter simply moves the arms with the weights thereon into a position where the bar is lifted by only the user.

If, when a user has completed exercising, he is unable to press the bar 126 upwardly far enough to reach the height of the cradles 90, he can simply set the bar on the lugs 46*a,b*. The user presses the bar 126 slightly upwards and sets the bar 126 on the top surfaces 48 of the lugs 46*a,b*. The pin 125 which extends upwardly just beyond the top surface 48 prevents the bar 126 from rolling off of the lugs onto the user.

The ability of the user to set the bar 126 on the lugs 46*a,b* in case of emergency benefits not only the user, but any spotter who might be aiding the user. In particular, if the user needs assistance in moving the bar 126 at all, the spotter need only lift the bar 126 a short distance to get it in the safety position. Because this position is much lower than the cradles 90, the spotter can use his stronger leg muscles to effectuate the upward movement of the bar 126, as opposed to weaker shoulder, lower back, and arm muscles.

As a further aspect of the present invention, the above-described weight-bar support can be adapted to several other structures. For example, the same structure as described above can be used in conjunction with a "decline" or "incline" bench press. Preferred embodiments of such structures are disclosed below.

Figure 6:
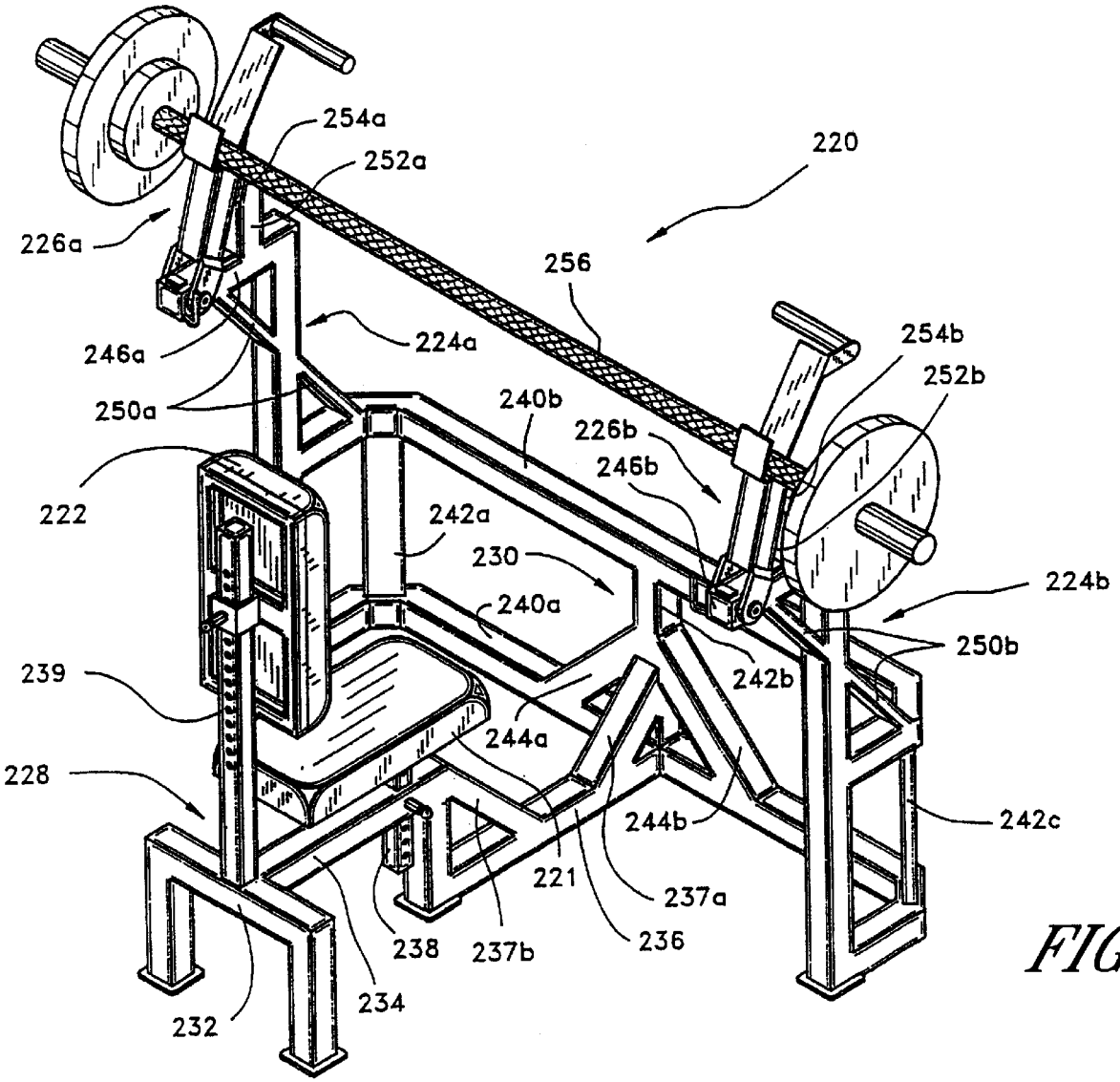
FIG. 6 is a perspective view of a second embodiment of the structure of the present invention with arms thereof in a retracted position.

FIG. 6 illustrates a second embodiment of the present invention, a device 220 useful for a "military" press exercise. In this form of the invention, the device 220 includes a user supporting platform in the form of a seat 221 and seat back 222, and a weight-bar support structure in the form of two upwardly extending posts 224*a,b* and a weight-bar supporting arm 226*a,b* positioned on each post.

The seat 221 is supported by a seat support structure 228, and the posts 224*a,b* and seat support structure are connected by a frame 230. The seat support structure 228 preferably includes a "U"-shaped member 232 having ends which contact the ground, a horizontal support 234, and an "L"-shaped, ground-contacting support 236.

The horizontal support 234 extends between the "U"-shaped member and the "L"-shaped support. The "L"-shaped support 236 extends between the horizontal support 234 and the frame 230. Preferably, a brace 237*b* extends from the horizontal support 234 to a point along the "L"-shaped support and a brace 237*a* extends from the frame 230 to a point along the "L"-shaped member.

The seat 221 is movably mounted to the horizontal support 234 via a seat post 238. Preferably, the seat post 238 is connected to a bottom surface of the seat 221, and passes through a bore or passageway running vertically through the horizontal support 234. The height of the seat 221 is adjustable, the post 238 having a number of bores therein for engagement with a spring-loaded pin passing through the support 234. Preferably, the seat is padded and sized for supporting a user in a seated position thereon.

A seat back support post 239 extends upwardly from the "U"-shaped member for supporting the seat back 222. Preferably, the post extends upwardly about 20–30, and most preferably about 25.5 inches. In order that a user may adjust the vertical position of the seat back 222, a number of bores pass through the post 239 for engagement by a spring-loaded pin which passes through a member connected to a rear surface of the seat back 222. As with the seat 221, the seat back 222 is preferably padded, and sized for supporting the back of a user in a substantially vertical position.

The frame 230 preferably includes two sets of spaced rails 240*a,b* extending between the posts 224*a,b*. The "L"-shaped member 236 of the seat supporting structure 228 is connected to a lower of the two rails 240*a*, which rests on the ground. The other rail 240*b* is preferably located about 12 inches vertically above the lower rail. Three vertical supports 242*a,b,c* preferably extend between the two rails 240*a,b*. Two of the supports 242*a,c* extend between the rails 240*a,b* near the ends thereof. A central support 242*b* extends between the rails 240*a,b* at the point where the "L"-shaped support 236 of the seat support structure 228 is connected to the lower rail 240*a*. Two braces 244*a,b* extend from either side of the central support 242*b* to a point along the lower rail 240*a* on either side thereof.

The rails 240*a,b* preferably have ends which extend approximately perpendicular to a central section of the rail, with the ends being connected to the posts 224*a,b*. The length of the rails 240*a,b* is preferably chosen so that the posts 224*a,b* are spaced between about 42–48, and most preferably about 45 inches apart.

The posts 224*a,b* extend vertically upwardly at the ends of the rails 240*a,b*. The posts 224*a,b* are preferably about 30–40, and most preferably about 36 inches tall. A lug 246*a,b* extends horizontally outwardly in the direction of the seat 221 at the top of each post 224*a,b*. Preferably, each lug 246*a,b* extends outwardly from its corresponding post between about 9–13, and most preferably about 11 inches.

A lug support 250*a,b* extends from the bottom surface of each lug 246*a,b* to the post 224*a,b*, and on from the post to the top surface of the top rail 240*b*. The lug support 250*a,b* preferably extends from near the outer end of the lug 246*a,b* to provide added support to the lug when a weight-bar is located on the device.

Weight-bar support means, preferably in the form of arms 226*a,b* are connected to the structure 220 and movable from a retracted position to an extended position. In particular, arms 226*a,b* identical to those described in conjunction with the weight bench set forth above, are mounted on the lugs 246*a,b*. As the mounting and construction of the arms 226*a,b* is preferably identical to the arms 26*a,b* described above, the description is omitted herefrom.

Preferably, a stop 252*a,b* extends upwardly from each lug 246*a,b* between the top of each post 224*a,b* and the arms 226*a,b*. Each stop 252*a,b* has a rearwardly sloping front face 254*a,b* to accommodate the rearwardly sloping arms 226*a,b*. Preferably, the stops 252*a,b* are mounted so that the sloping front faces 254*a,b* extend parallel to the sloping arms 226*a,b* and leave approximately 0.5–3 inches therebetween.

Use of this device 220 is as follows. A user locates a weight-bar 256, with or without additional weights thereon, on the device 220. The user places the bar 256 in a horizontal position in the cradles of the arms 226*a,b* with the arms 226*a,b* in retracted position (as illustrated in FIG. 6). In this position, the arms 226*a,b* support the ends of the bar 256.

Next, the user selects the proper height of the seat 221 and seat back 222, and sits down. The user or a spotter then moves the arms 226*a,b*, and thus the bar 256, into the lift-off or "extended" position (in this position, the arms 226*a,b* are in the position illustrated in FIG. 2). The user moves the bar into lift-off position by pulling slightly on any portion of the bar 256 or either arm 226*a,b*, pulling the arms 226*a,b* and bar 256 thereon in the direction of the seated user. A spotter can move the bar into lift-off position for a user by grasping the handles on the arms 256*a,b* and pushing them forwards.

In either instance, the weight bar 256 and arms 226*a,b,* along with any pulling or pushing force, rotate the arms to the lift-off position against the force provided by the spring or biasing means. Rotation of the arms 226*a,b* stops when the front edge thereof contacts the cushions on the lugs 246*a,b.* The cradle of the arms 226*a,b* prevents the bar 256 from sliding, bouncing or rolling from the cradle, without regard to how quickly the arms are moved into position.

Movement of the arms 226*a,b* to the extended position moves the bar 256 into a convenient location adjacent the user's chest, directly in front of him. Most importantly, however, by correctly positioning the seat, the user can position his body on the device 220 so that when the arms 226*a,b* are rotated, the bar is not only located in front of his chest, but is located directly adjacent his chest just below his shoulders. In other words, when the seat adjustment and arms are used together, every user of the device can orient himself on the device so that the when the arms 226*a,b* are extended, the bar is located in the correct starting position for the military press exercise corresponding to that user's body.

With the bar 256 so positioned, the user reaches out, grasping the bar 256 and lifting it from the arms 226*a,b.* As the user removes the bar 256 from the arms 226*a,b,* the reduced weight biasing force is overcome by the return biasing force acting on the arms 226*a,b,* causing the arms to move back to their retracted position. Movement of the arms 226*a,b* stops when the stop on each arm contacts the rear cushion on each lug 246*a,b.*

The user exercises by pressing the bar 256 vertically upwardly above his head, and then lowering it back down to his chest, in repeated fashion. Once done exercising, the user returns the bar 256 back to the cradles of the arms 226*a,b.* The user pushes the bar 256 outwardly until it hits the upwardly extending guide portions of the arms 226*a,b,* and then the user allows the bar 256 to slide down along the guide portions into the cradles of the arms 226*a,b.* As with the previous exercise, a spotter is preferably present during all phases of the exercise.

If, when a user has completed exercising, he is unable to maintain the bar 256 in a position of sufficient height that it will clear the cradle portions of the arms 226*a,b,* he can simply set the bar 256 on the ends of the lugs 246*a,b.* The pins on the end of each lug 246*a,b* prevents the bar from rolling off the lugs 246*a,b.*

Figure 7:
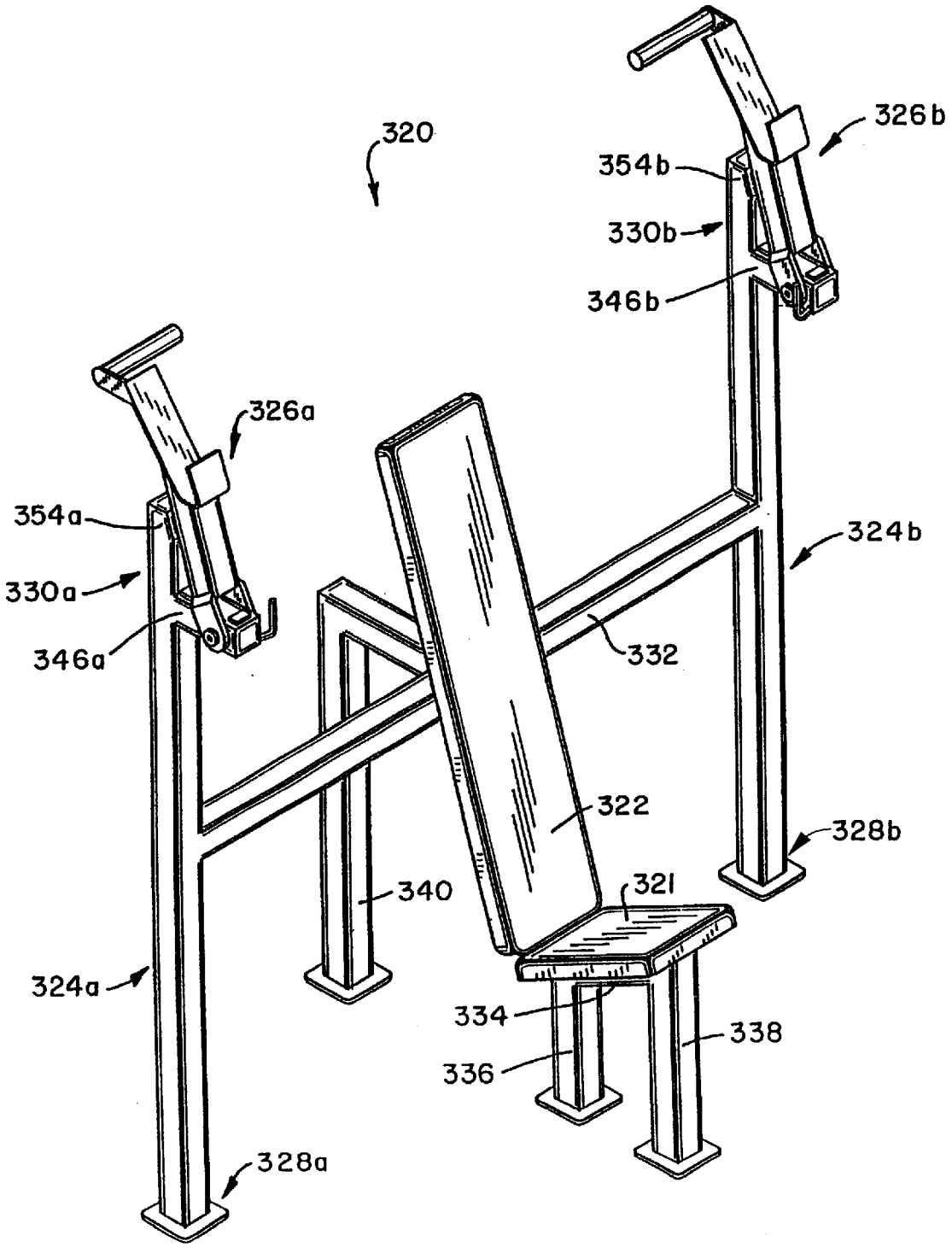
FIG. 7 is a perspective view of a third embodiment of the structure of the present invention with arms thereof in a retracted position.

FIG. 7 illustrates a third embodiment of the present invention, a device 320 useful for an "incline" press exercise. In this form of the invention, the structure 320 comprises a user supporting platform in the form of a seat 321 and an inclined back 322 sloping away from the seat 321, and a weight-bar supporting structure in the form of two upwardly extending posts 324*a,b* and a weight-bar supporting arm 326*a,b* positioned on each post.

The posts 324*a,b* have a first end 328*a,b* and a second end 330*a,b.* The posts 324*a,b* extend vertically upwardly from the first end 328*a,b* which rests on the ground. The posts 324*a,b* are preferably between about 50–70, and most preferably about 60 inches in height.

A horizontal support 332 extends between the posts 324*a,b.* The support 332 is about 40–50, and most preferably about 45 inches in length, spacing the posts 324*a,b* apart by the same distance. Preferably, the support 332 is located about 30–35, and most preferably 32 inches above the ground.

Lugs 346*a,b* extend outwardly from each of the posts 326*a,b* about 5–12, and most preferably about 8 inches. Preferably, the lugs 346*a,b* extend outwardly from the posts 326*a,b* about 8–12 inches down from the top or second ends 330*a,b* thereof, and at an angle perpendicular thereto.

The seat 321 is located on the same side of the structure 320 as the lugs 346*a,b.* Preferably, the seat 321 is centered about midway between the posts 324*a,b,* and supported by a frame member 334.

The frame member 334 extends from the support 332 downwardly and outwardly therefrom at an angle, and then extends outward perpendicular to the support. The seat 321 is located on top of the portion of the frame member 334 extending perpendicular to the support. This portion of the frame member 334 (and thus the seat 321) is supported by a pair of legs 336,338 extending down from the frame member 334 to the ground. The rear edge of the seat 321 is positioned between about 10–20, and most preferably about 15 inches in front of the support 332.

Preferably, the seat 321 tilts upwardly from a rear end which is closest the support 332 and a front end which is farthest from the support. In particular, the front of the two legs 338 is preferably slightly longer than the other leg, so that the seat 321 tilts upwardly at an angle of approximately 25–35, and most preferably about 30 degrees with respect to the horizontal.

The seat back 322 extends from the rear portion of the seat upwardly along the frame 334. Preferably, the back 322 is about 20–40, and most preferably about 30 inches tall, terminating at approximately the same height as the posts.

As stated above, the frame 334 on which the back 322 is mounted extends at an angle vertically upward from the seat support portion to a connection with the support 332, on upwardly past the support. Because the frame 334 rises at an incline, the back 322 on which it is mounted does also. In particular, a lower portion of the back 322 is positioned adjacent the rear edge of the seat 321, and in front of the support 332, and a top portion of the back 322 is located behind the support 332. Preferably, the back 322 tilts rearwardly at an angle of between about 10 and 50 degrees with respect to the vertical.

In order to stabilize the support 332 in the area of the seat/back frame 334, an "L"-shaped leg 340 extends first outwardly from the support 332 opposite the seat 321, and then downwardly to the ground.

Weight-bar support means, preferably in the form of arms 326*a,b* are connected to the structure 320 and movable from a retracted position to an extended position. In particular, arms 326*a,b* identical to those described in conjunction with the weight bench set forth above, are mounted on the lugs 346*a,b.* As the mounting and construction of the arms 326*a,b* is preferably identical to the arms 26*a,b* described above, the description is omitted herefrom.

The top of each post 324*a,b* has a rearwardly sloping front face 354*a,b* to accommodate the rearwardly sloping arms 326*a,b.* Preferably, the sloping front faces 354*a,b* extend parallel to the sloping arms 326*a,b* and leave approximately 0.5–3 inches therebetween.

Use of this device 320 is as follows. A user locates a weight-bar (not shown), with or without additional weights thereon, on the device 320. The user places the bar in a horizontal position, in the cradles of the arms 326*a,b* with the arms 326*a,b* in retracted position (as illustrated in FIG. 7). In this position, the arms 326*a,b* support the ends of the bar.

The user sits on the seat 321, leaning back with his back supported by the seat back 322. When seated, the user faces away from the device 320 (in the same direction that the lugs 346*a,b* extend outwardly). The user or a spotter then moves the arms 326*a,b,* and thus the bar, into the lift-off or "extended" position (in this position, the arms 326,*a,b* are in the position illustrated in FIG. 2). The user moves the bar into lift-off position by pulling slightly on any portion of the bar or either arm 326*a,b,* pulling the arms 326*a,b* and bar thereon in the direction of the seated user. A spotter can move the bar into lift-off position for a user by grasping the handles on the arms 326*a,b* and pushing them forwards.

In either instance, the weight bar and arms 326*a,b,* along with any pulling or pushing force, rotate the arms to the lift-off position against the force provided by the spring or biasing means. Rotation of the arms 326*a,b* stops when the front edge thereof contacts the cushions on the lugs 346*a,b.* The cradle of the arms 326*a,b* prevents the bar from sliding, bouncing or rolling from the cradle, without regard to how quickly the arms are moved into position.

At this time, the bar is conveniently located slightly in front of the user, and adjacent his chest. The user reaches out, grasping the bar and lifting it from the arms 326*a,b.*

As the user removes the bar from the arms 326*a,b,* the reduced weight biasing force is overcome by the return biasing force acting on the arms 326*a,b,* causing the arms to move back to their retracted position. Movement of the arms 326*a,b* stops when the stop on each arm contacts the rear cushion on each lug 346*a,b.*

The user exercises by pressing the bar vertically upwardly above his chest, and then lowering it back down, in repeated fashion. Once done exercising, the user returns the bar back to the cradles of the arms 326*a,b.* The user pushes the bar outwardly until it hits the upwardly extending guide portions of the arms 326*a,b,* and then the user allows the bar to slide down along the guide portions into the cradles of the arms 326*a,b.* As with the previous exercises, a spotter is preferably present during all phases of the exercise.

If, when a user has completed exercising, he is unable to maintain the bar in a position of sufficient height that it will clear the cradle portions of the arms 326*a,b,* he can simply set the bar on the ends of the lugs 346*a,b.* The pins on the end of each lug 346*a,b* prevents the bar from rolling off the lugs 346*a,b.*

Figure 8:
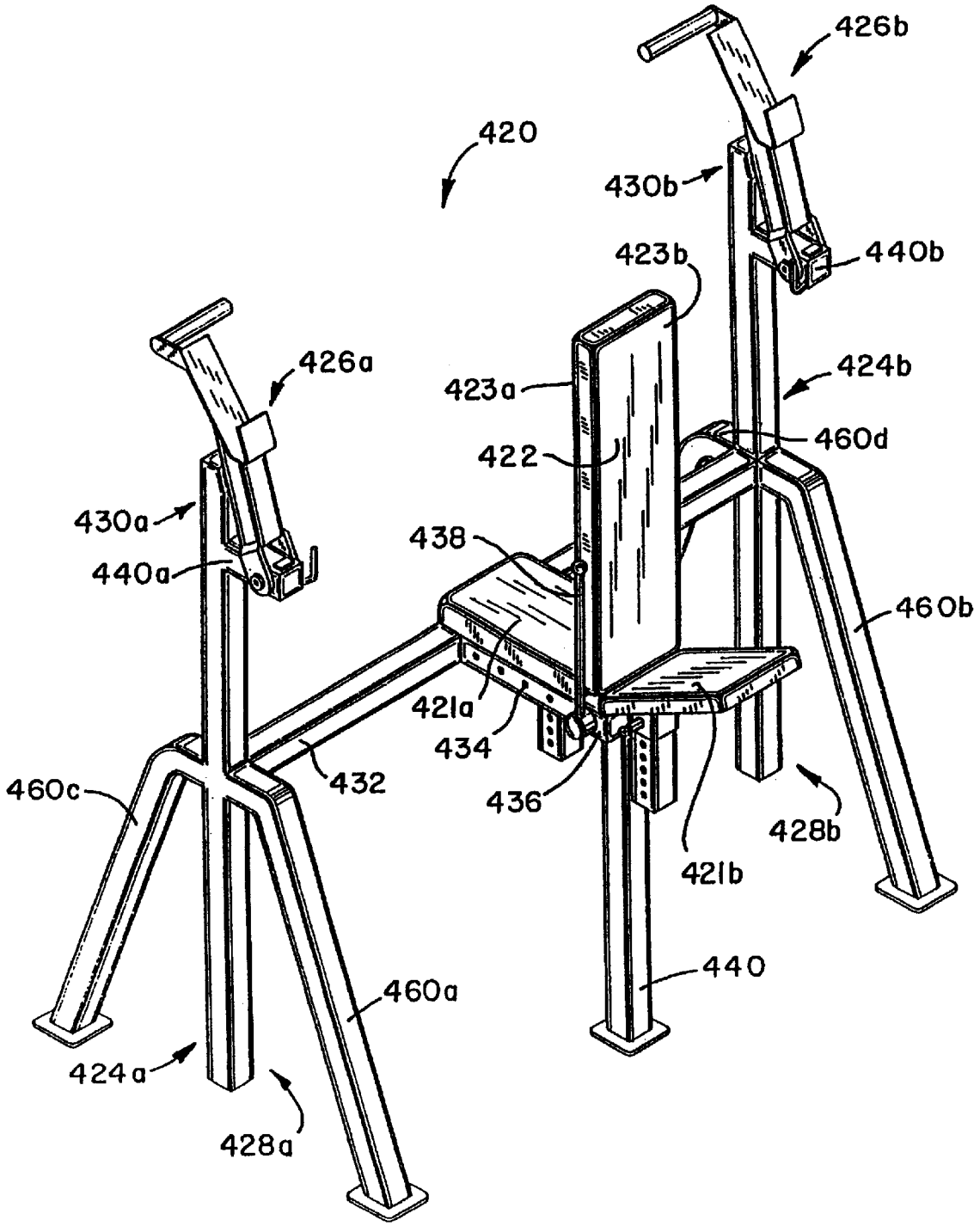
FIG. 8 is a perspective view of a fourth embodiment of the structure of the present invention with arms thereof in a retracted position.

FIG. 8 illustrates a forth embodiment of the present invention, a device 420 useful in either an "incline" press or "military" press exercise. In this form of the invention, the device 420 includes a user supporting platform in the form of a first seat member 421*a,* a second seat member 421*b* and a seat back 422, and a weight-bar supporting structure in the form of two upwardly extending posts 424*a,b* and a weight-bar supporting arm 426*a,b* positioned on each post.

This form of the invention is nearly identical to the last, except for the addition of two post braces 460*a,b,c,d* extending from each post 424*a,b,* and a different seat configuration.

In this form of the invention, a first seat portion 421*a* extends horizontally outwardly from the support between the posts 424*a,b* in the same direction as the lugs 446*a,b.* A second seat portion 421*b* extends from the first seat portion 421*a.* The seat back 422 extends upwardly between the two seat portions 421*a,b.*

The seat portions 421*a,b* are supported by a frame member 436 extending horizontally outwardly from the support 432 extending between the two posts 424*a,b.* A leg 440 extends downwardly from the frame member 436 to the ground to support the seat portions.

Preferably, the seat back 422 is movable between a first upright position and a second inclined position. In the position illustrated in FIG. 1, a first side 423*a* of the seat back 422 supports the back of a user when the user is seated on the first seat portion 421*a.* A second side 423*b* of the seat back 422 supports the back of a user when the user is seated on the second seat portion 421*b.*

Means for moving the seat back 422 from a vertical to an inclined position are provided. Preferably, the means comprise a number of bores 434 located in the frame member 436 for engagement by a pin passing through a bore in a seat back support strut 438. Other means may be employed, such as use of hydraulic cylinders, telescoping posts, or the like.

The second seat portion 421*b* is inclined. In particular, the second seat portion 421*b* rises at an angle of between about 20–40, and most preferably 30 degrees with respect to the horizontal.

The overall height of the first and second seat portions 421*a,b* can preferably be adjusted. In particular, each seat portion 421*a,b* is mounted on a post having bores passing therethrough for engagement by a spring-loaded pin.

As with the devices described above, this weight-bar support means in the form of movable arms 426*a,b* are mounted on the lugs 446*a,b.* The construction of the arms 426*a,b* are preferably the same as the arm 26 detailed above.

Use of this device 420 is as follows. A user locates a weight-bar (not shown), with or without additional weights thereon, on the device 420. The user places the bar in a horizontal position, in the cradles of the arms 426*a,b* with the arms 426*a,b* in retracted position (illustrated in FIG. 7). In this position, the arms 426*a,b* support the ends of the bar.

To do a "military" press exercise, the user places the seat back 422 in an upright or vertical position (as illustrated in FIG. 8). The user then sits on the first seat portion 421*a* with his back pressed against the first side 423*a* of the seat back 422. The user thus faces the arms 426*a,b.* Use of the structure is then identical to that illustrated in FIG. 6 as described above.

If the user wishes to do an "incline" press exercise, the user reclines the seat back 422 so that it tilts rearwardly towards the arms 426*a,b.* The user accomplishes this task by removing the pin in the strut 438, moving the strut 438 rearwardly, and then repinning the strut 428 to the frame 436.

The user then seats himself on the second seat portion 421*b,* leaning back with his back supported by the second side 423*b* of the seat back 422. In this position, the user faces away from the arms 426*a,b.* Use of the structure is then identical to the use of the structure illustrated in FIG. 7 as described above.

In accordance with the present invention, numerous variations of the elements described above are possible for accomplishing the present invention.

For example, the platform 22 of the first form of the invention which supports the exerciser need not be directly connected to the support structure 20. The support structure 20 of the present invention may simply comprise the posts 24*a,b,* with the lugs and arms connected thereto. In this form, the structure should include means for supporting the posts in stationary fashion, such as by anchoring the posts in concrete, bolting them to the floor, or providing additional stabilizing elements. A separate user supporting platform is then used in conjunction with the weight-bar support structure.

While the arms (26*a,b,* 226*a,b,* 326*a,b,* 426*a,b*) are described above as moving from the retracted to the lift-off position in rotatable fashion, the arm might be connected to the structure and move between these positions in a combination of translating and rotating, or solely translating movement.

Further, while the structures and devices 20,220,320,420 described above have two arms, it is possible that a single arm be used to support the weight-bar. In particular, a single arm which is moveable between a retracted and lift-off position and which includes a widened bar supporting portion may be used to support the bar. Alternatively, three or more arms may be provided for supporting the bar.

Also, the return means for moving the arms 26*a,b,* 226*a,b,* 326*a,b,* 426*a,b* from the lift-off to the retracted position may include a helical spring, hydraulic or air actuated piston, electrically operated motor means, or other means for effectuating movement known in the art.

Figure 9:
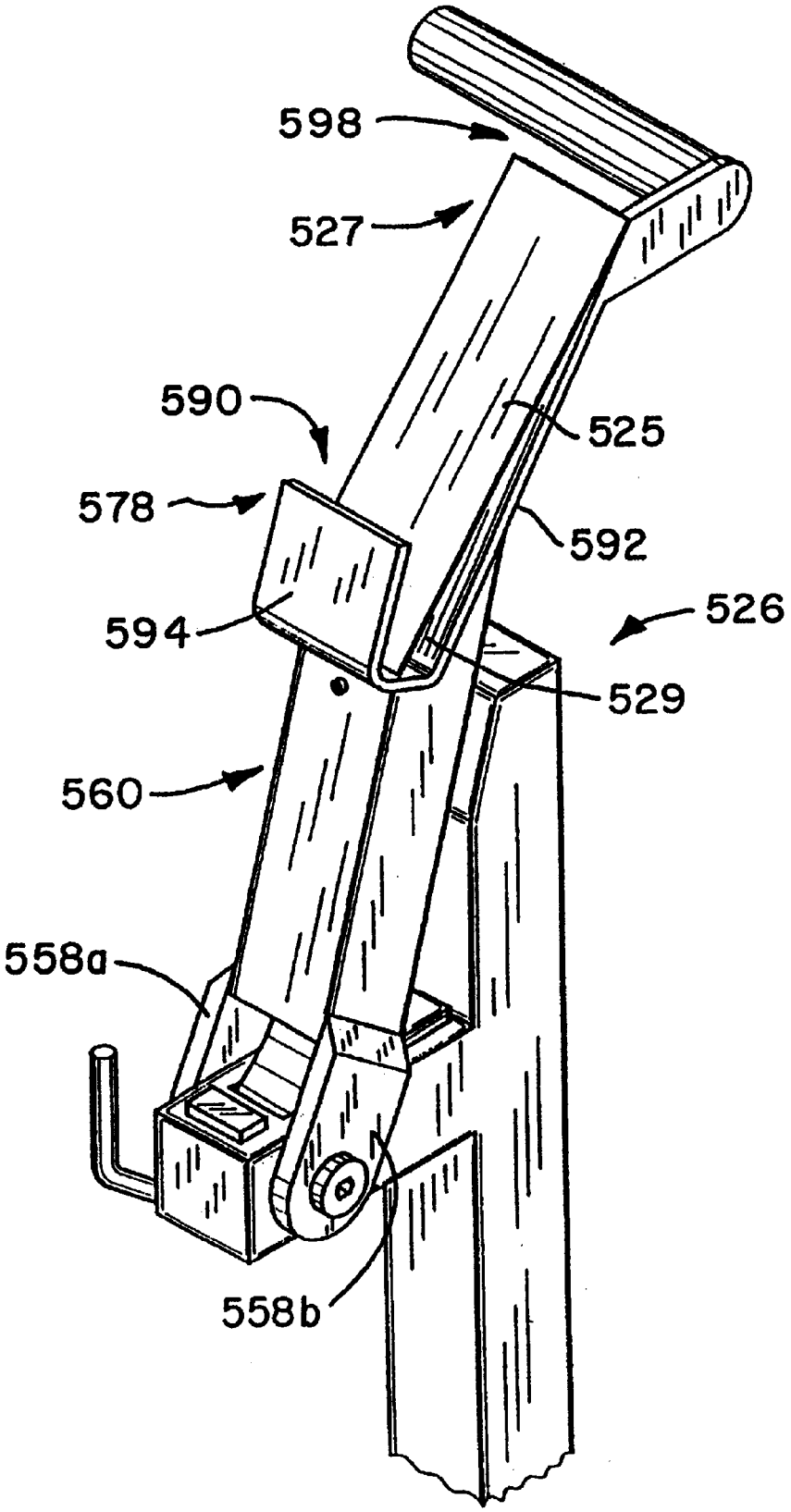
FIG. 9 is a perspective view of an alternate embodiment arm for use with the structures of the present invention.
Figure 10:
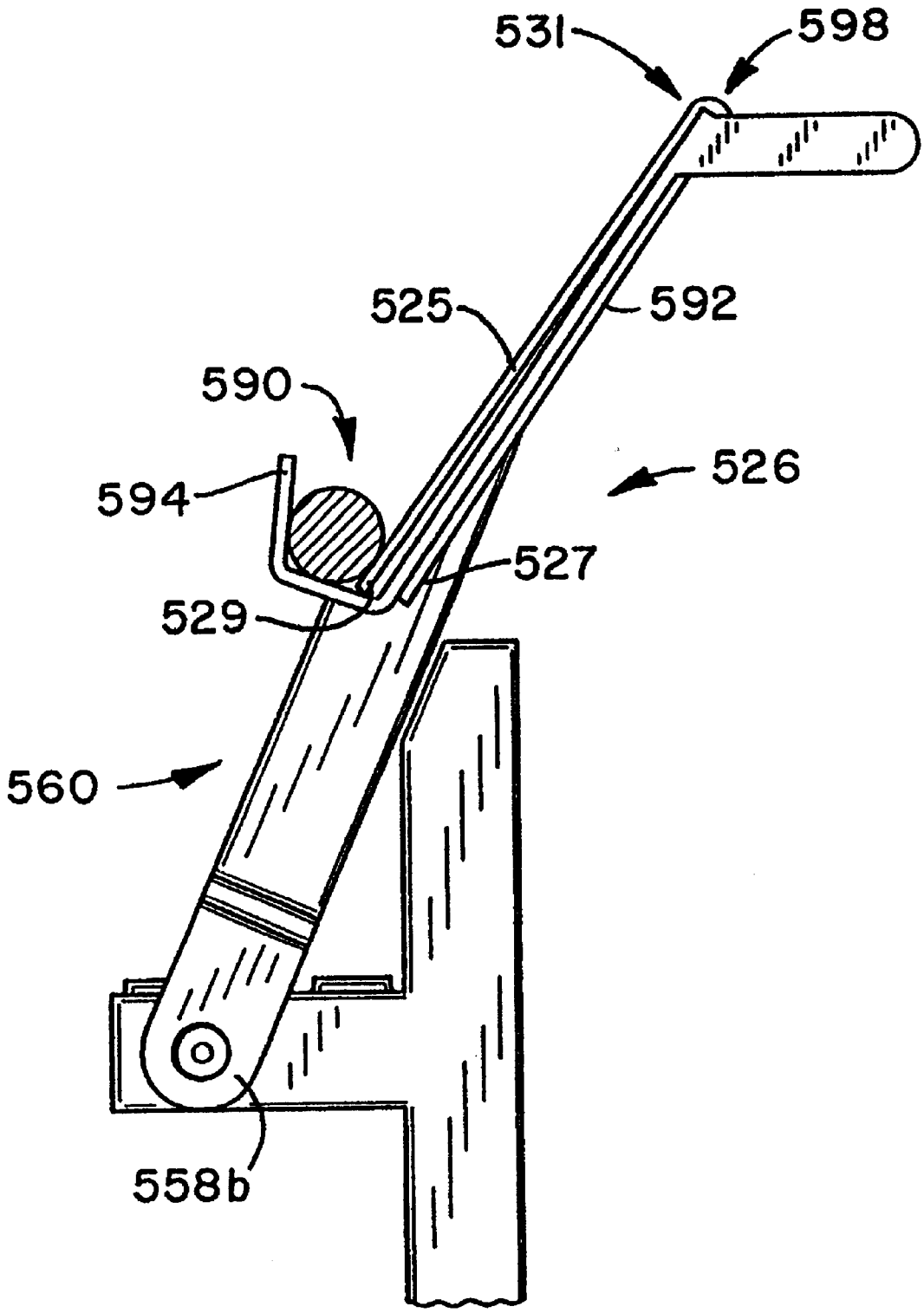
FIG. 10 is a side view of the arm illustrated in FIG. 9.

FIGS. 9 and 10 illustrate a modified arm 526 for use with any of the above-described forms of the present invention In general, the arm 526 is similar to the arm 26 described above, the arm 526 including a central portion 560 having flanges 558*a,b* extending downward from a first end thereof, and having a weight-bar supporting member 578 at a second end thereof. The weight-bar supporting member 578 is "J"-shaped, having a cradle 590 at one end, and an upwardly extending guide 592. In addition, however, in this embodiment of the arm 526, an insert 525 extends from a top end 598 of the guide downwardly along the guide to the cradle 590.

The insert 525 is preferably a flat metal member which is bent into a "V"-shape, having a first end 527, a second end 529, and a bend 531. The first end 527 is located on the side of the guide 592 opposite the cradle, and attached thereto by welding or the like. The insert 525 extends from the first end 527 along the back side of the guide and over the top end 598 of the guide, with the bend 531 of the insert extending over the top end 598 of the guide. The insert 525 extends from the bend 598 downwardly to the second end 529 which is located in the area defined by the cradle 590.

The insert 525 may vary in width from approximately the same width as the guide 592, to around half the width of the guide. The second end 529 terminates near enough the bottom of the cradle 590 that a weight-bar can not slip under the insert and become lodged between the insert and guide.

Because the insert 525 is constructed from a flat sheet of metal which is bent the sides of the insert can move with respect to one another. Because the first end 527 of the insert 525 is fixed to the guide 592, the second end 529 extends, in its static state, outwardly into the cradle 590, thus providing a biasing force.

The use and purpose of the insert 525 is as follows. As described above in conjunction with the description of the arm 26, the cradle must have a width sufficient to hold a variety of different sized weight-bars placed therein. At the same time, however, the cradle must tightly hold the weight-bar so that when the arm moves back and forth, the weight-bar does not come out of the cradle. Further, if the bar is in contact with the front stem of only one cradle and the user pulls the bar forward, movement of only one arm is initially effectuated. This causes a "torquing" on the arms as created by the mass of the weight bar.

As disclosed above, in order to hold most weight bars, the cradle must have a width of about 1.5 inches. In some instances, however, a user may have a weight bar having a diameter smaller than the width of the cradle, such as 1.25 inches. If a bar which is smaller than the cradle is placed in the cradle, the weight-bar is not tightly held in the cradle and can bounce or twist out of the cradle.

The insert 525 of the present invention holds the weight-bar tightly in the cradle. In particular, the insert 525 presses the weight-bar forward against the front stem of the cradle, as illustrated in FIG. 10.

It is possible for the insert 525 to be located on the front stem of the cradle, extending down along the stem into the cradle trough. It is also possible for the insert 525 to be attached to the guide somewhere along the length thereof rather than at the top.

It is also possible to mount several narrow inserts on the same arm. Use of several narrow insert strips allows the manufacturer of the device to manipulate the generated biasing force and the location of this force.

In an alternate form of the invention, the need for an insert 525 may be alleviated by having the weight-bar support member tilt forwardly with respect to the arm, instead of rearwardly as illustrated in FIG. 5. The particular angle of tilt should then be selected so that when a weight-bar is placed in the arms in their resting position, the bar rolls forwardly against the front stem of each cradle.

It will be understood that the above described arrangements of apparatus and the method therefrom are merely illustrative of applications of the principles of this invention and many other embodiments and modifications may be made without departing from the spirit and scope of the invention as defined in the claims.

I claim:

1. A support structure for supporting a user and a weight-laden bar comprising:

a user-engaging platform;

a support structure including a platform-supporting portion and two posts that extend above the platform;

an arm for holding a weight-bar pivotably connected to each of the posts, each arm movable between a first retracted position and a second weight-bar lift-off position; and return means for moving each arm from the lift-off position to the retracted position when a weight bar is removed from the arms in the lift-off position; wherein the arms are configured to support a weight-laden bar in both the first retracted position and the second weight-bar lift-off position and the arms are inclined in both the first retracted position and the second weight-bar lift-off position.

2. The support structure of claim 1, wherein the platform supporting portion includes a cross-member extending between the posts.

3. The support structure of claim 1, wherein each arm has a first end portion connected to a lug extending outwardly from each post.

4. The support structure of claim 3, where the first end portion of each arm includes two downwardly extending flanges.

5. The support structure of claim 3, wherein the first end portion of each arm includes a downwardly extending flange located on each of first and second sides of each lug.

6. The support structure of claim 3, wherein the first end portion of each arm is connected to the corresponding lug with at least one pin.

7. The support structure of claim 6, wherein a first pin passes through a first side of each arm into said lug, and a second pin passes through a second side of said arm into each lug.

8. The support structure of claim 7, wherein the pins include a smooth portion for engaging a sleeve located in each side of each arm.

9. The support structure of claim 1, wherein each arm includes a first end portion and second end portion, the first end portion connected to one of the posts and the second end portion including means for supporting a weight-bar.

10. The support structure of claim 9, wherein the means for supporting a weight-bar includes a U-shaped cradle.

11. The support structure of claim 10, wherein a bottom portion of the cradle is substantially flat.

12. The support structure of claim 1, further including a weight-bar guide connected to each arm.

13. The support structure of claim 12, wherein each guide comprises a member extending upwardly and sloping away from the user engaging platform.

14. The support structure of claim 1, further including a user engaging handle connected to each arm.

15. The support structure of claim 1, wherein the return means comprises at least one spring.

16. The support structure of claim 15, wherein each spring has a first end portion connected to one of the arms and a second end portion connected to the corresponding post.

17. The support structure of claim 16, wherein each second end portion of each spring engages a slot located in each lug located on each post.

18. The support structure of claim 16, wherein each first end portion of each spring is located in a hollow portion of each arm.

19. The support structure of claim 1, further including stop means for limiting the movement of each arm.

20. A weight-bar supporting structure comprising:

a user-supporting platform;

a support structure including two upwardly extending posts;

an arm pivotably connected to each of the posts, each arm movable between a first retracted position and a second weight-bar lift-off position; and return means for moving the arms from the lift-off position to the retracted position when a weight bar is removed from the arms in the lift-off position; wherein when the arms are in the lift-off position, a weight-bar supported on the arms is adapted to be positioned above a user's chest and the arms are inclined in both the lift-off and retracted positions.

* * * * *